US012022868B2

(12) United States Patent
Qiu et al.

(10) Patent No.: US 12,022,868 B2
(45) Date of Patent: Jul. 2, 2024

(54) CARTRIDGE AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Chenchang Wu, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 673 days.

(21) Appl. No.: 17/199,460

(22) Filed: Mar. 12, 2021

(65) Prior Publication Data

US 2021/0227883 A1 Jul. 29, 2021

Related U.S. Application Data

(63) Continuation-in-part of application No. PCT/CN2019/104764, filed on Sep. 6, 2019.

(30) Foreign Application Priority Data

Sep. 13, 2018 (CN) ..... 201821498493.6

(51) Int. Cl.
*A24F 40/42* (2020.01)
*A24F 40/10* (2020.01)
*A24F 40/51* (2020.01)

(52) U.S. Cl.
CPC ..... *A24F 40/42* (2020.01); *A24F 40/10* (2020.01); *A24F 40/51* (2020.01)

(58) Field of Classification Search
CPC ..... A24F 40/51; A24F 40/50; A24F 40/40; A24F 40/42; A24F 40/00; A24F 40/10
(Continued)

(56) References Cited

U.S. PATENT DOCUMENTS 4,945,931 A 8/1990 Gori
2021/0227883 A1* 7/2021 Qiu ..... A24B 15/167

FOREIGN PATENT DOCUMENTS

CN 206423570 U 8/2017
CN 206651395 U 11/2017
(Continued)

OTHER PUBLICATIONS

The extended European Search Report of EP Application No. 19859477.2 issued on May 24, 2022.

*Primary Examiner* — Khiem M Nguyen
(74) *Attorney, Agent, or Firm* — Andrew C. Cheng

(57) ABSTRACT

A cartridge includes a main body with a liquid storage chamber therein, a bottom cover mounted at the open end of the main body, and a rotating liquid injection cover mounted to the bottom cover. The bottom cover is provided with a liquid injection opening and a pressure relief opening both of which are in communication with the liquid storage chamber. The rotating liquid injection cover is provided with a first communication opening and a second communication opening. The rotating liquid injection cover rotates about an axis relative to the bottom cover. The rotating liquid injection cover can be rotated to a position in which the first communication opening is staggered from the liquid injection opening, and a position in which the first communication opening is in communication with the liquid injection opening and the second communication opening is in communication with the pressure relief opening.

16 Claims, 5 Drawing Sheets

(58) Field of Classification Search
USPC ..... 131/329
See application file for complete search history.

(56) References Cited

FOREIGN PATENT DOCUMENTS

| | | | |
|---|---|---|---|
| CN | 206687178 | U | 12/2017 |
| CN | 207236084 | U | 4/2018 |
| CN | 209047456 | U | 7/2019 |
| WO | 2018024213 | A1 | 2/2018 |

* cited by examiner

CARTRIDGE AND ELECTRONIC CIGARETTE

CROSS-REFERENCE TO RELATED APPLICATIONS

This application is a continuation-in-part of International Patent Application No. PCT/CN2019/104764, filed on Sep. 6, 2019, entitled "cartridge and electronic cigarette", which claims priority to Chinese Patent Application No. 201821498493.6, filed on Sep. 13, 2018. The aforementioned patent applications are hereby incorporated by reference in their entireties.

TECHNICAL FIELD

The present disclosure relates to the technical field of electronic cigarette, and more particularly, relates to a cartridge and an electronic cigarette.

BACKGROUND

Nowadays, electronic cigarettes are accepted by more and more people due to their advantages of hygiene, environmental protection, convenient use, and diverse taste experience. Whether it is high-power e-cigarettes pursuing taste and coolness, or small or disposable e-cigarettes pursuing practicality and convenience, there are more and more markets.

Among the liquid injection methods of e-cigarettes currently on the market, one way is to inject liquid by opening the cartridge with the atomizing core, and because the corresponding structures in the cartridge are arranged through a threaded connection, the liquid injection operation of the electronic cigarette is complicated; another method is to pull out the liquid injection rubber plug and then perform liquid injection, the problem with this liquid injection method is that the user's hand is easy to touch the e-liquid on the liquid injection rubber plug, and the user experience is not good.

SUMMARY

In view of the above, it is necessary to provide a cartridge and an electronic cigarette with simple liquid injection operation and good user experience.

A cartridge, includes:

a main body with a liquid storage chamber therein, the main body including a semi-closed end and an open end opposite to the semi-closed end;

a bottom cover mounted to the open end of the main body, the bottom cover provided with a liquid injection opening and a pressure relief opening both of which are in communication with the liquid storage chamber; and a rotating liquid injection cover mounted to the bottom cover, the rotating liquid injection cover provided with a first communication opening and a second communication opening;

wherein the rotating liquid injection cover rotates about an axis relative to the bottom cover, the rotating liquid injection cover can be rotated to a position in which the first communication opening is staggered from the liquid injection opening, and a position in which the first communication opening is in communication with the liquid injection opening and the second communication opening is in communication with the pressure relief opening.

In one embodiment, the rotating liquid injection cover rotates relative to the bottom cover around the axis within a preset arc length.

In one embodiment, the rotating liquid injection cover includes a cover body and a limiting buckle, the bottom cover includes a seat and a mating buckle, the limiting buckle is protruded from the outer edge of the cover body, the mating buckle is protruded from the outer edge of the seat and is located on the rotation path of the limiting buckle, the limiting buckle is reciprocally rotatable to be engaged with the mating buckle within a preset arc length.

In one embodiment, a surface of the bottom cover facing the rotating liquid injection cover is provided with a guiding groove, a surface of the rotating liquid injection cover facing the bottom cover is protruded to provide with a guiding post, the guiding post is slidably arranged in the guiding groove.

In one embodiment, the main body is provided with an air inlet, the cartridge further includes a housing and an air regulating member, the housing is sleeved outside the main body and is provided with a sliding groove in communication with the air inlet, the air regulating member is assembled in the sliding groove and can slide relative to the sliding groove between a closed position of covering the air inlet and an open position of opening the air inlet.

In one embodiment, an outer surface of the main body is provided with first adjusting teeth, the first adjusting teeth is formed at the periphery of the air inlet and is located on the sliding path of the air regulating member from the closed position of covering the air inlet to the open position of opening the air inlet, a surface of the air regulating member facing the first adjusting teeth is provided with second adjusting teeth engaging with the first adjusting teeth.

In one embodiment, the main body is provided with an air intake passage extending through the semi-closed end and the open end of the main body, the air inlet is in communication with the air intake passage, the bottom cover is provided with a sensing air passage in communication with the air intake passage, the rotating liquid injection cover is provided with a connecting through hole in communication with the sensing air passage.

In one embodiment, the cartridge includes an atomizing core, the bottom cover is provided with an assembling hole; the liquid injection opening, the pressure relief opening and the sensing air passage are all arranged at the outer periphery of the assembling hole; an air inlet end of the atomizing core is detachably mounted to the rotating liquid injection cover; an air outlet end of the atomizing core is detachably inserted into the assembling hole and extends into the main body; the air inlet, the air intake passage, the gap between the housing and the semi-closed end of the main body, and the inside space of the atomizing core jointly form an atomizing airflow path.

In one embodiment, the cartridge includes a vent tube, the vent tube is detachably assembled at the air outlet end of the atomizing core, the housing is provided with an air outlet at a position corresponding to the vent tube.

An electronic cigarette includes a cartridge provided above and a battery device configured for providing electric driving for the cartridge.

A cartridge, includes:

a main body with a liquid storage chamber therein, the main body including an upper end and a lower end, the main body provided with an air intake passage extending through the upper end and the lower end of the main body and an air inlet in communication with the air intake passage;

a bottom cover mounted at the lower end of the main body, the bottom cover provided with a sensing air passage in communication with the air intake passage and a liquid injection opening and a pressure relief opening both of which are in communication with the liquid storage chamber; and a rotating liquid injection cover mounted to the bottom cover, the rotating liquid injection cover provided with a connecting through hole in communication with the sensing air passage, a first communication opening and a second communication opening;

wherein the rotating liquid injection cover rotates about an axis relative to the bottom cover, the rotating liquid injection cover can be rotated between a first position and a second position;

in the first position, the first communication opening is staggered from the liquid injection opening, the second communication opening is staggered from the pressure relief opening, and the connecting through hole is aligned with and in communication with the sensing air passage;

in the second position, the first communication opening is in communication with the liquid injection opening, the second communication opening is in communication with the pressure relief opening, and the connecting through hole is staggered from the sensing air passage.

In one embodiment, the bottom cover includes a seat and a mating buckle formed on the seat, the rotating liquid injection cover includes a cover body and a limiting buckle formed on the cover body, when the rotating liquid injection cover is located in the first position, the limiting buckle is engaged with the mating buckle, when the rotating liquid injection cover is rotated from the first position to the second position, the limiting buckle is disengaged from the mating buckle.

In one embodiment, the limiting buckle is protruded from the outer edge of the cover body, the mating buckle is protruded from the outer edge of the seat and is located on the rotation path of the limiting buckle.

In one embodiment, the mating buckle defines a mating groove along the rotation path of the limiting buckle, the mating groove has a blocking wall on the path through which the limiting buckle rotates into the mating groove, the limiting buckle is rotated into the mating groove through the entrance of the mating groove and is blocked by the blocking wall facing the entrance of the mating groove.

In one embodiment, the limiting buckle is protruded to form a limiting protrusion facing the bottom cover, the mating buckle is provided with a limiting groove corresponding to the limiting protrusion and in communication with the mating groove, the limiting protrusion is engaged into the limiting groove when the limiting protrusion is rotated into the mating groove.

In one embodiment, a surface of the bottom cover facing the rotating liquid injection cover is provided with a guiding groove, the guiding groove is arc-shaped, a surface of the rotating liquid injection cover facing the bottom cover is protruded to provide with a guiding post, the guiding post is slidably arranged in the guiding groove so that the rotating liquid injection cover rotates about the axis relative to the bottom cover within a preset arc length.

In one embodiment, the cartridge further includes an atomizing core, the bottom cover is provided with an assembling hole, the rotating liquid injection cover is provided with a receiving hole corresponding to the assembling hole; one end of the atomizing core is inserted into the receiving hole and is detachably mounted to the rotating liquid injection cover, the other end of the atomizing core is detachably inserted into the assembling hole and extends into the main body.

In one embodiment, the liquid injection opening, the pressure relief opening, the sensing air passage and the guiding groove are arranged at the outer periphery of the assembling hole; the first communication opening, the second communication opening and the connecting through hole are arranged at the outer periphery of the receiving hole.

In one embodiment, the cartridge further includes a housing and an air regulating member, the housing is sleeved outside the main body and is provided with a sliding groove in communication with the air inlet, the air regulating member is assembled in the sliding groove and can slide along the sliding groove between a closed position of covering the air inlet and an open position of opening the air inlet.

In one embodiment, the air inlet is located at one end of the sliding groove, an outer surface of the main body is provided with first adjusting teeth, the first adjusting teeth is located on the sliding path of the air regulating member from the closed position of covering the air inlet to the open position of opening the air inlet, a surface of the air regulating member facing the first adjusting teeth is provided with second adjusting teeth engaging with the first adjusting teeth.

The beneficial effects of the present disclosure are:

In the cartridge and the electronic cigarette of the present disclosure, the rotating liquid injection cover arranged at the bottom of the cartridge can rotate relative to the bottom cover under the action of an external force, so that during the liquid injection process, the liquid injection can be realized only by misaligning the two to expose the liquid injection opening, the operation is simple and convenient. At the same time, the bottom cover is further provided with the pressure relief opening, when the liquid injection opening is exposed, the pressure relief opening also communicates with the outside environment at the same time, so as to prevent the injected e-liquid from overflowing due to the air pressure in the liquid storage chamber.

Figure 1:
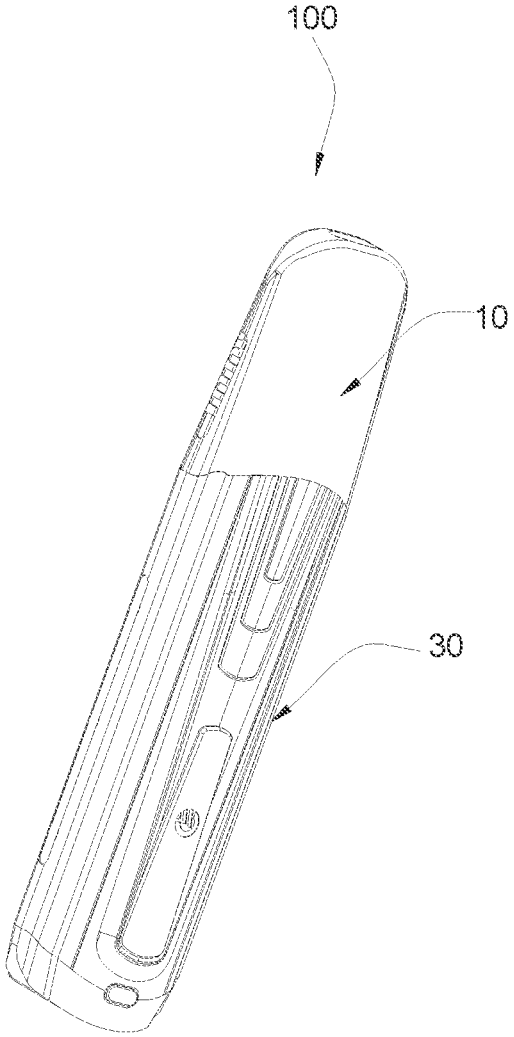
FIG. 1 is a schematic diagram of the structure of an electronic cigarette in an embodiment of the present disclosure.

The reference numerals for various components in the drawings are as follows:

| | |
|---|---|
| Electronic cigarette 100 | Cartridge 10 |
| Main body 11 | Liquid storage chamber 110 |
| Air intake passage 112 | Atomizing core mounting space 114 |
| Air inlet 116 | First adjusting teeth 117 |
| Sealing pad 12 | Bottom cover 13 |
| Liquid injection opening 130 | Sensing air passage 131 |
| Pressure relief opening 132 | Assembling hole 133 |
| Seat 134 | Mating buckle 136 |
| Mating groove 1363 | Blocking wall 1365 |
| Limiting groove 1367 | Guiding groove 138 |
| Rotating liquid injection cover 15 | First communication opening 150 |
| Connecting through hole 151 | Second communication opening 152 |
| Receiving hole 153 | Cover body 154 |
| Blind hole 155 | Limiting buckle 156 |
| Limiting protrusion 1561 | Sealing groove 157 |
| Atomizing core 17 | Housing 18 |
| Sliding groove 181 | Air outlet 182 |
| Air regulating member 19 | Second adjusting teeth 191 |
| Anti-skidding portion 193 | Vent tube 20 |
| Sealing gasket 22 | Battery device 30 |
| Sealing ring 14 | |

DETAILED DESCRIPTION OF PREFERRED EMBODIMENTS

In order to facilitate the understanding of the present disclosure, the present disclosure will be described in details with reference to the accompanying drawings. Preferred embodiments of the present disclosure are given in the drawings. However, the present disclosure can be realized in many different forms and is not limited to the embodiments described herein. On the contrary, the purpose of providing these embodiments is to make a more thorough and comprehensive understanding of the disclosed contents of the present disclosure.

It should be noted that when an element is referred to as being "fixed to" another element, it may be directly on the other element or there may be a centered element. When an element is considered to be "connected" to another element, it can be directly connected to the other element or intervening elements may also be present.

Unless defined otherwise, all technical and scientific terms used herein have the same meaning as commonly understood by one of ordinary skill in the art to which this disclosure belongs. The terms used herein in the description of the present disclosure are only for the purpose of describing specific embodiments, and are not intended to limit the present disclosure. The term "and/or" as used herein includes any and all combinations of one or more of the associated listed items.

Please refer to FIG. 1, in one embodiment of the present disclosure, the electronic cigarette 100 includes a cartridge 10 and a battery device 30 for providing electric driving for the cartridge 10. The cartridge 10 is used to store e-liquid and atomize the e-liquid absorbed to form smoke for the user to inhale under the electric driving of the battery device 30.

In one embodiment, the cartridge 10 and the mouthpiece may be integrated formed, that is, the cartridge 10 itself has a mouthpiece for the user to suck. In another embodiment, the cartridge 10 and the mouthpiece are arranged separately, that is, the mouthpiece is detachably connected to the cartridge 10, which is not limited herein.

Figure 2:
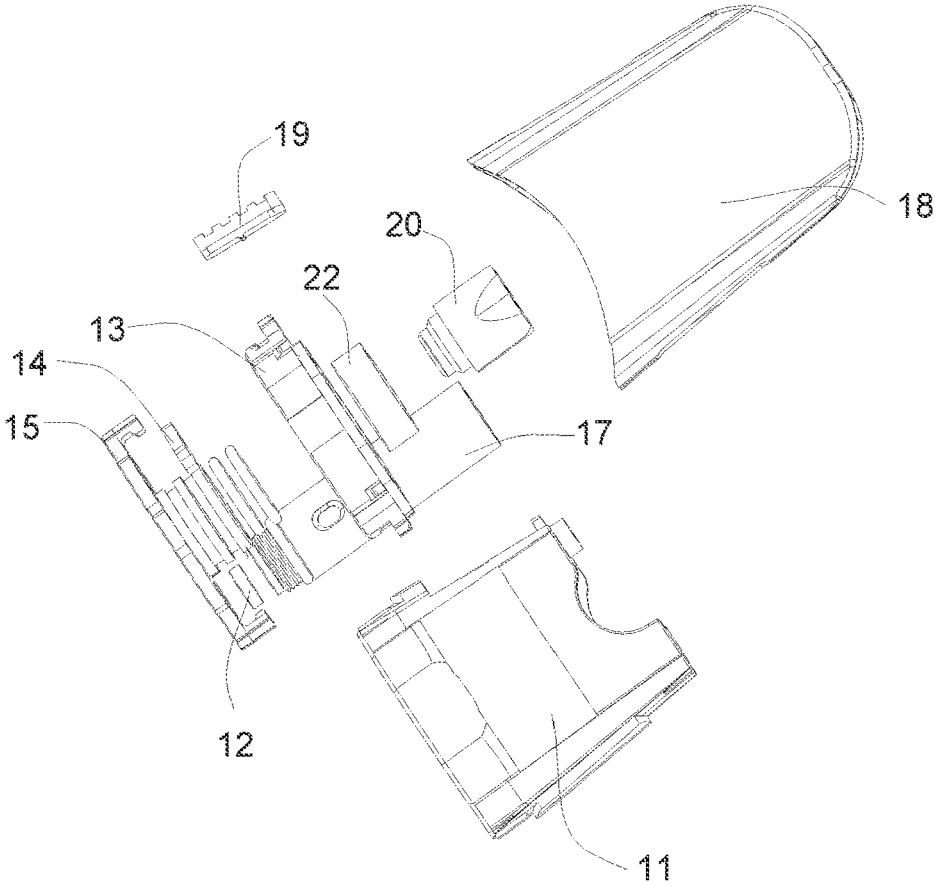
FIG. 2 is an exploded, schematic diagram of the cartridge of the electronic cigarette shown in FIG. 1.
Figure 3:
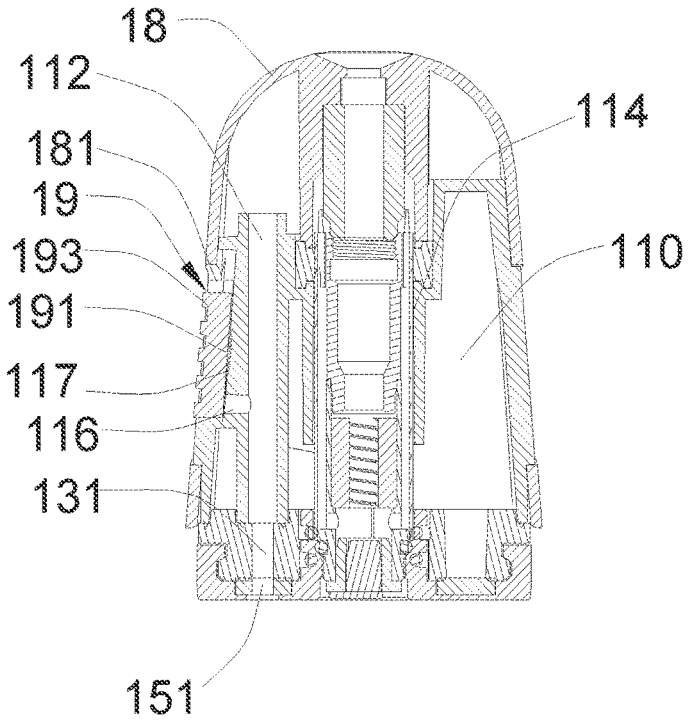
FIG. 3 is a cross-sectional view of the cartridge shown in FIG. 2.

Please refer to FIG. 2 and FIG. 3, the cartridge 10 includes a main body 11, a bottom cover 13, a rotating liquid injection cover 15 and an atomizing core 17. The main body 11 has a liquid storage chamber 110 for storing e-liquid. The bottom cover 13 is engaged with the main body 11, and is constructed together with the main body 11 to form the cartridge 10 having the liquid storage chamber 110 and being installed with the atomizing core 17 therein. The rotating liquid injection cover 15 is engaged with the bottom cover 13, and can rotate relative to the bottom cover 13 when operated by a user, so as to allow the user to inject e-liquid. The atomizing core 17 is installed in the main body 11. The liquid storage chamber 110 is communicated with the liquid inlet of the atomizing core 17. Under the electric driving of the battery device 30, the atomizing core 17 atomizes the e-liquid absorbed from the liquid storage chamber 110.

Specifically, the main body 11 is generally in the shape of a semi-closed hollow cylinder, and includes a semi-closed end and an open end opposite to the semi-closed end. When the electronic cigarette 100 is in normal use, the semi-closed end of the main body 11 is the top end provided with a mouthpiece or used to mount a mouthpiece, and the open end of the main body 11 is the bottom end to which the battery device 30 is connected.

Please refer to FIG. 3, an interior of the main body 11 is configured to have the liquid storage chamber 110, an air intake passage 112 and an atomizing core mounting space 114. The bottom cover 13 is mounted at the open end of the main body 11 and forms the liquid storage chamber 110 together with the main body 11. The air intake passage 112 and the atomizing core mounting space 114 are formed by other structure of walls protruding from the inner wall of the main body 11, and will not be described in detail here.

Figure 4:
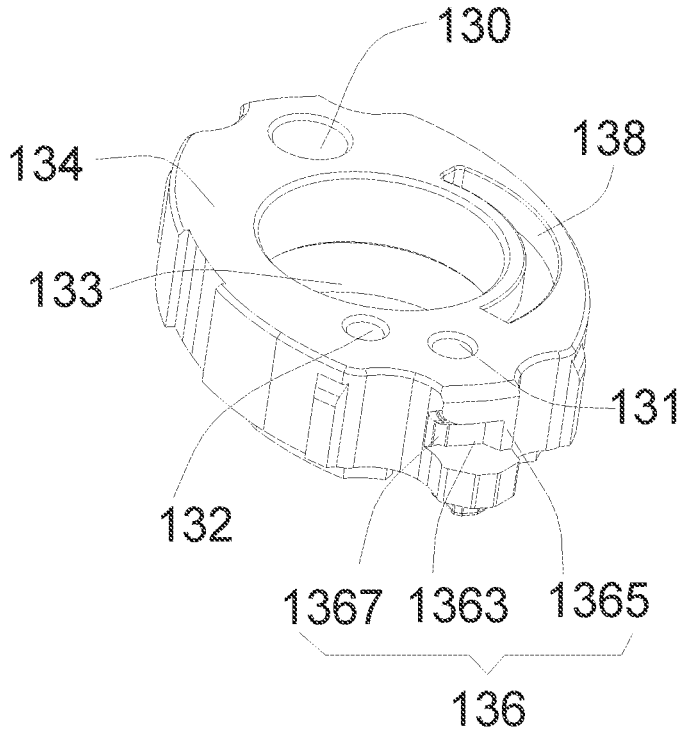
FIG. 4 is a schematic diagram of the structure of the bottom cover of the cartridge shown in FIG. 2.
Figure 5:
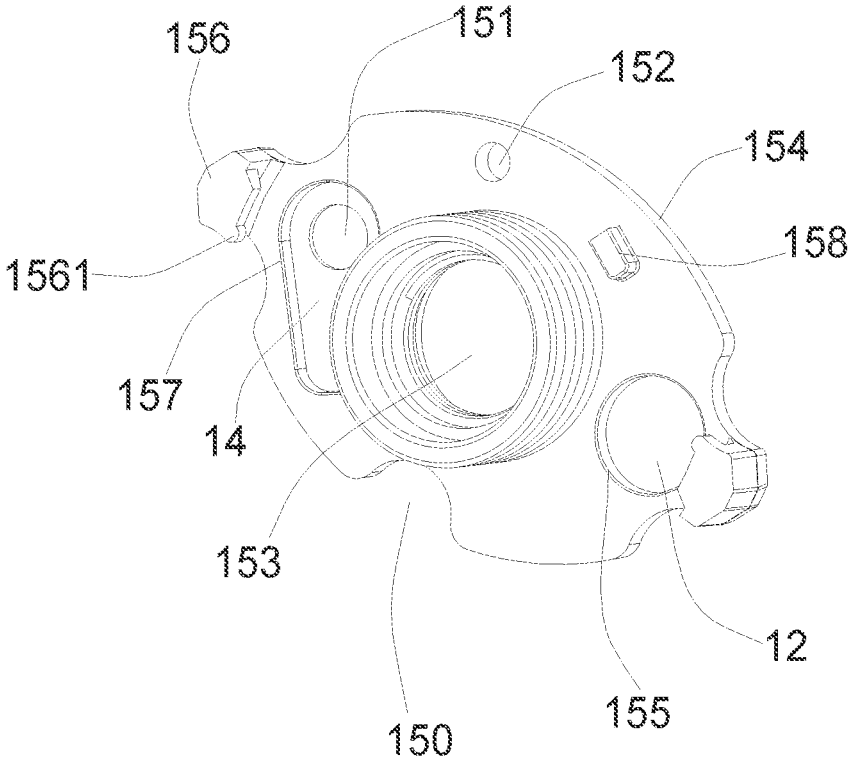
FIG. 5 is a schematic diagram of the structure of the rotating liquid injection cover of the cartridge shown in FIG. 2.

Please refer to FIGS. 3, 4 and 5, the bottom cover 13 is provided with a sensing air passage 131 in communication with the air intake passage 112. The rotating liquid injection cover 15 is provided with a connecting through hole 151 in communication with the sensing air passage 131. Since the connecting through hole 151 is in communication with the sensing air passage 131 and the sensing air passage 131 is in communication with the air intake passage 112, the parameter changes of air pressure, air flow rate or the like around the sensor will be affected by the user's suction action. When the value of one or more of these parameters changes and reaches the preset range, the sensor will be triggered to send a signal to the control board, and then the control board sends out the corresponding operation signal.

In this specific embodiment, the surface of the rotating liquid injection cover 15 facing the bottom cover 13 is provided with a sealing groove 157. The sealing groove 157 surrounds the outer circumference of the connecting through hole 151. The cartridge 10 includes a sealing ring 14, the sealing ring 14 is sealed in the sealing groove 157 and sleeved around the sensor mounted in the sensing air passage 131 to prevent the air entering the air intake passage 112 from leaking, and at the same time to prevent the e-liquid from passing through the connecting through hole 151 to enter the position of the sensor and affect the sensitivity of the sensor.

The bottom cover 13 is provided with a liquid injection opening 130 and a pressure relief opening 132, both of which are in communication with the liquid storage chamber 110. The rotating liquid injection cover 15 is provided with a first communication opening 150 and a second communication opening 152. The rotating liquid injection cover 15 can be rotated about an axis (for example, the central axis of the smoke outlet passage of the cartridge 10) relative to the bottom cover 13. The rotating liquid injection cover 15 can be rotated to a position in which the first communication opening 150 and the liquid injection opening 130 are staggered from each other, and to a position in which the first communication opening 150 is in communication with the liquid injection opening 130 and the second communication opening 152 is in communication with the pressure relief opening 132.

When the electronic cigarette 100 is in normal use, the rotating liquid injection cover 15 is located relative to the bottom cover 13 at a position in which the first communication opening 150 is staggered from the liquid injection opening 130, the liquid injection opening 130 is sealed to prevent the e-liquid in the liquid storage chamber 110 from leaking through the liquid injection opening 130. When injecting e-liquid to the electronic cigarette 100, the rotating liquid injection cover 15 is located relative to the bottom cover 13 at a position in which the first communication opening 150 is in communication with the liquid injection opening 130 and the second communication opening 152 is in communication with the pressure relief opening 132. The liquid injection opening 130 is in communication with the outside through the first communication opening 150, so that the injection nozzle of the e-liquid bottle can extend into the liquid injection opening 130 through the first communication opening 150 to inject e-liquid into the liquid storage chamber 110. At the same time, because the pressure relief opening 132 is in communication with the outside through the second communication opening 152, thus the pressure in the liquid storage chamber 110 is the same as the outside air pressure, to prevent the injected e-liquid from overflowing due to the pressure difference between the liquid storage chamber 110 and the external environment.

In this specific embodiment, the first communication opening 150 for matching with the liquid injection opening 130 is a notch formed on the edge of the rotating liquid injection cover 15. It can be understood that, in other embodiments, the first communication opening 150 can also be a hole provided on the rotating liquid injection cover 15, which is not limited herein.

Please refer to FIGS. 4 and 5, in one embodiment, the rotating liquid injection cover 15 is rotated relative to the bottom cover 13 around an axis within a preset arc length.

Specifically, the bottom cover 13 includes a seat 134 and a mating buckle 136, and the rotating liquid injection cover 15 includes a cover body 154 and a limiting buckle 156. The cover body 154 is arranged directly below the seat 134, that is, the seat 134 is located between the main body 11 and the cover body 154. The limiting buckle 156 is protruded from the outer edge of the cover body 154. The mating buckle 136 is protruded from the outer edge of the seat 134 and is located on the rotation path of the limiting buckle 156. The limiting buckle 156 is reciprocally rotatable to be engaged with the mating buckle 136 within a preset arc length.

The mating buckle 136 defines a mating groove 1363 along the rotation path of the limiting buckle 156, and the mating groove 1363 has a blocking wall 1365 on the path through which the limiting buckle 156 rotates into the mating groove 1363. The limiting buckle 156 is rotated into the mating groove 1363 through the entrance of the mating groove 1363, and is blocked by the blocking wall 1365 facing the entrance of the mating groove 1363 to limit the further rotation of the limiting buckle 156 and prevent the limiting buckle 156 from being accidentally rotated out from the other end of the mating groove 1363 due to an excessive force during the rotation.

Further, the limiting buckle 156 is protruded to form a limiting protrusion 1561 facing the bottom cover 13, the mating buckle 136 is provided with a limiting groove 1367 at a position corresponding to the limiting protrusion 1561 and in communication with the mating groove 1363.

The depth of the limiting groove 1367 relative to the mating buckle 136 is greater than the depth of the mating groove 1363 relative to the mating buckle 136, so that the limiting protrusion 1561 can be engaged into the limiting groove 1367 when the limiting protrusion 1561 is rotated into the mating groove 1363.

In one embodiment, the limiting groove 1367 can be formed by recessing inward from the groove wall of the mating groove 1363; and in another embodiment, the limiting groove 1367 can be directly formed on the connecting surface between the mating buckle 136 and the mating groove 1363, which is not limited herein.

Figure 7:
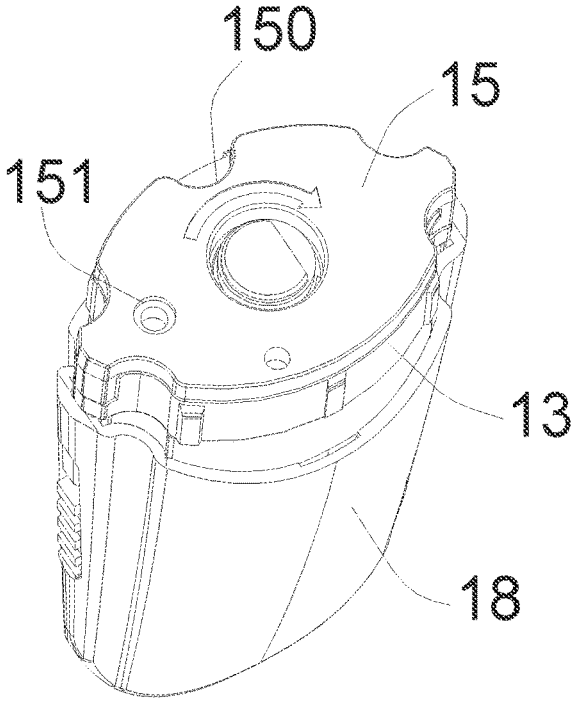
FIG. 7 is a diagram of the cartridge shown in FIG. 2 in the normal use state.
Figure 8:
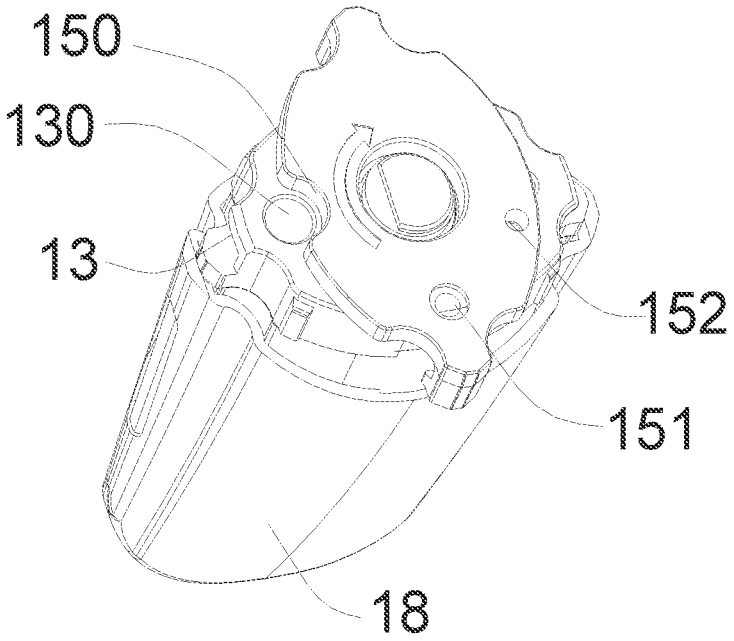
FIG. 8 is a diagram of the cartridge shown in FIG. 2 in the liquid injection state.

In this embodiment, the number of the mating buckle 136 is two, and they are respectively formed by protruding on opposite sides of the seat 134. Correspondingly, the number of the limiting buckles 156 is two, and they are respectively formed by protruding on the opposite sides of the cover body 154 and cooperate with the two mating buckles 136. The opening directions of the matching grooves 1363 on the two mating buckles 136 are opposite, so as to limit the rotating liquid injection cover 15 to be able to rotate relative to the bottom cover 13 within a preset arc length. Referring to FIGS. 7 and 8, the rotating liquid injection cover 15 can only rotate clockwise relative to the bottom cover 13 around the axis from the position in which the first communication opening 150 is staggered from the liquid injection opening 130 to the position in which the first communication opening 150 is in communication with the liquid injection opening 130, and can reset counterclockwise; this movement arc length is the preset arc length (excluding the arc length of the reset process). However, the rotating liquid injection cover 15 cannot be rotated counterclockwise around the axis from the position in which the first communication opening 150 is staggered from the liquid injection opening 130 to the position in which the first communication opening 150 is in communication with the liquid injection opening 130.

It is understood that in some other embodiments, the rotating liquid injection cover 15 can rotate in a clockwise or counterclockwise direction relative to the bottom cover 13 from the position in which the first communication opening 150 is staggered from the liquid injection opening 130 to the position in which the first communication opening 150 is in communication with the liquid injection opening 130. Alternatively, the rotating liquid injection cover 15 can only rotate counterclockwise relative to the bottom cover 13 around the axis from the position in which the first communication opening 150 is staggered from the liquid injection opening 130 to the position in which the first communication opening 150 is in communication with the liquid injection opening 130. It is only required that the rotating liquid injection cover 15 can rotate relative to the bottom cover 13 from the position in which the first communication opening 150 is staggered from the liquid injection opening 130 to the position in which the first communication opening 150 is in communication with the liquid injection opening 130, and can reset, which is not limited here.

Further, a surface of the bottom cover 13 facing the rotating liquid injection cover 15 is provided with a guiding groove 138. A surface of the rotating liquid injection cover 15 facing the bottom cover 13 is protruded to provide with a guiding post 158. The guiding post 158 is slidably arranged in the guiding groove 138 to limit the rotation stroke of the rotating liquid injection cover 15 relative to the bottom cover 13 to prevent it from shaking randomly.

In one of the embodiments, the surface of the rotating liquid injection cover 15 facing the bottom cover 13 is provided with a blind hole 155. When the rotating liquid injection cover 15 is connected to the bottom cover 13, the blind hole 155 is aligned with the liquid injection opening 130 of the bottom cover 13. The cartridge 10 includes a sealing pad 12, which is received in the blind hole 155 and is used to seal the liquid injection opening 130 when the electronic cigarette 100 is in normal use (that is, when the rotating liquid injection cover 15 is not rotated relative to the bottom cover 13) to avoid liquid leakage.

Figure 6:
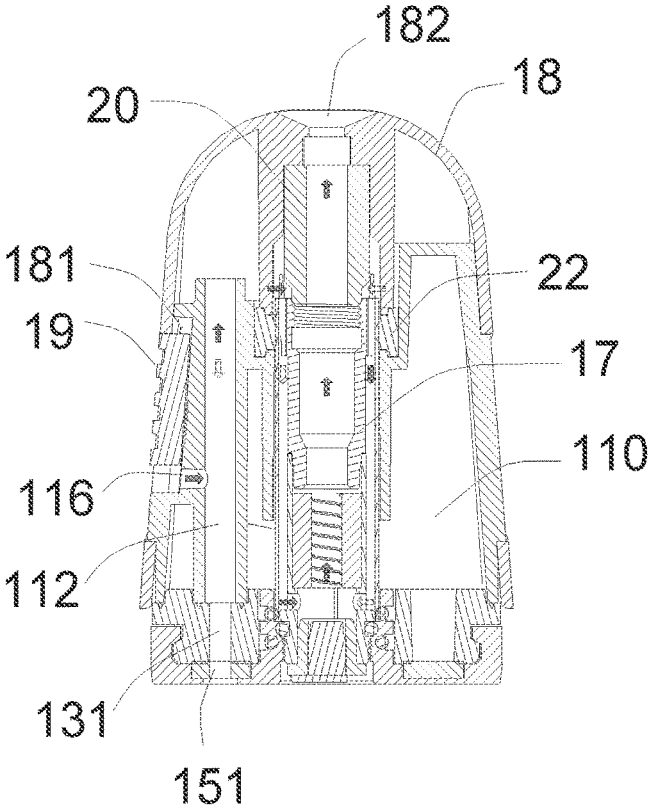
FIG. 6 is a schematic diagram of the airflow directions of the cartridge shown in FIG. 2.

Please refer to FIGS. 2, 3 and 6, in one of the embodiments, the main body 11 is provided with an air inlet 116. The cartridge 10 further includes a housing 18 and an air regulating member 19. The housing 18 is sleeved outside the semi-closed end of the main body 11 and is provided with a sliding groove 181 in communication with the air inlet 116. The air regulating member 19 is assembled in the sliding groove 181 and can slide along the sliding groove 181 between a closed position of covering the air inlet 116 and an open position of opening the air inlet 116.

Please refer to FIGS. 3 and 6, when the air regulating member 19 slides along the sliding groove 181 to near the end of the air inlet 116, the air regulating member 19 completely covers the air inlet 116, and the air inlet 116 is closed at this time, as shown in FIG. 3. When the electronic cigarette 100 is in normal use, the air regulating member 19 slides along the sliding groove 181 in a direction away from the air inlet 116 under the action of an external force to open the air inlet 116, as shown in FIG. 6. Moreover, the air intake area of the air inlet 116 can be changed according to the sliding distance of the air regulating member 19, so that the air intake amount of the cartridge 10 can be adjusted.

Further, the outer surface of the main body 11 is provided with first adjusting teeth 117. The first adjusting teeth 117 are formed at the periphery of the air inlet 116 and is located on the sliding path of the air regulating member 19 from the closed position of covering the air inlet 116 to the open position of opening the air inlet 116. A surface of the air regulating member 19 facing the first adjusting teeth 117 is provided with second adjusting teeth 191 engaging with the first adjusting teeth 117 to fix the air regulating member 19 in place.

In addition, the surface of the air regulating member 19 facing away from the second adjusting teeth 191 is provided with an anti-skidding portion 193 to increase the friction between the user's finger and the air regulating member 19.

In this specific embodiment, the air intake passage 112 extends through the semi-closed end and the open end of the main body 11, and the air inlet 116 is in communication with the air intake passage 112, so that the air intake passage 112 can be used as a sensing channel for the sensor and can also provide a passage for the outside air used for atomizing.

Please refer to FIGS. 4, 5 and 6, the atomizing core 17 is mounted to the rotating liquid injection cover 15, extends through the bottom cover 13 into the main body 11, and is limited in the atomizing core mounting space 114. The atomizing core 17 is used to heat and atomize the e-liquid adsorbed from the liquid storage chamber 110.

Specifically, the bottom cover 13 is provided with an assembling hole 133, the rotating liquid injection cover 15 is provided with a receiving hole 153 at a position corresponding to the assembling hole 133. The liquid injection opening 130, the pressure relief opening 132 and the sensing air passage 131 are all arranged at the outer periphery of the assembling hole 133.

The air inlet end of the atomizing core 17 is inserted into the receiving hole 153 and is detachably mounted to the rotating liquid injection cover 15. The air outlet end of the atomizing core 17 is detachably inserted into the assembling hole 133 and extends into the main body 11. The air inlet end received in the receiving hole 153 is electrically connected to the battery device 30 through electrode contacts, so that the battery device 30 provides electric driving for the atomizing core 17.

Figure 9:
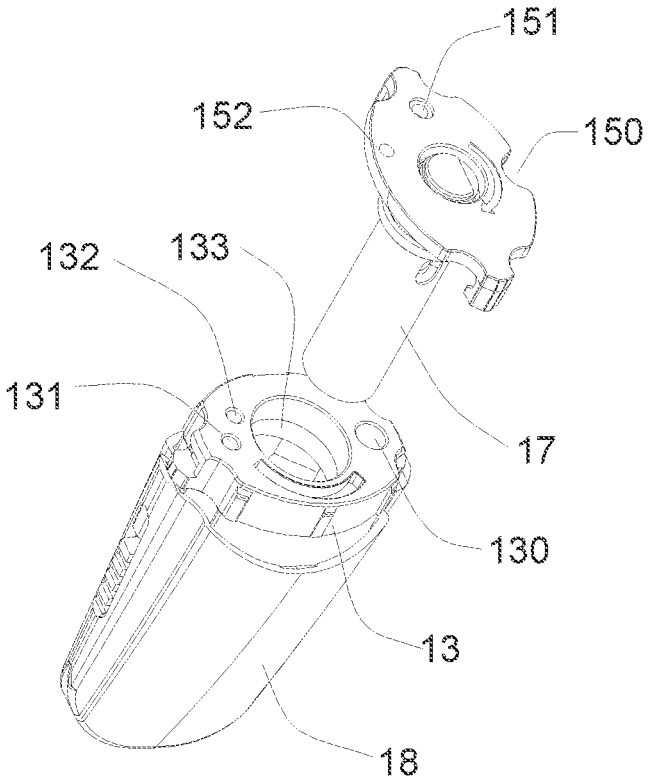
FIG. 9 is a diagram of the cartridge shown in FIG. 2 when the atomizing core is replaced or maintained.

Referring to FIG. 6, the air inlet 116, the air intake passage 112, the gap between the housing 18 and the semi-closed end of the main body 11, and the inside space of the atomizing core 17 jointly form an atomizing airflow path, so that the outside air enters the atomizing core 17 through the atomizing airflow path under the suction force of the user, and is mixed with the smoke in the atomizing core 17 for the user to inhale through the mouthpiece (as shown in the direction of the arrows). At the same time, since the atomizing core 17 is mounted to the rotating liquid injection cover 15 and is detachably assembled to the main body 11 and the bottom cover 13, so that when the limiting buckle 156 of the rotating liquid injection cover 15 is rotated out from the mating buckle 136, the atomizing core 17 together with the rotating liquid injection cover 15 can be removed from the bottom cover 13, as shown in FIGS. 8 and 9, which is convenient for the replacement of the atomizing core 17 and later maintaining.

Further, the cartridge 10 includes a vent tube 20, which is detachably assembled at the air outlet end of the atomizing core 17. The housing 18 is provided with an air outlet 182 at a position corresponding to the vent tube 20, so that the air mixed with the smoke can flow out through the air outlet 182 under the user's suction action for the user to inhale.

Further, the cartridge 10 includes a sealing gasket 22, which is assembled on the main body 11 and sleeved outside the air outlet end of the atomizing core 17 to seal the gap between the air outlet end of the atomizing core 17 and the main body 11.

In this embodiment, the housing 18 is a mouthpiece that is sleeved outside the main body 11, that is, the air outlet 182 is the smoke outlet of the mouthpiece, and the user can directly suck through the housing 18 sleeved outside the main body 11. It can be understood that, in other embodiments, a mouthpiece can be additionally mounted to the air outlet 182 for the user to suck, which is not limited here.

Please refer to FIG. 7, when the electronic cigarette 100 is in normal use, the rotating liquid injection cover 15 overlaps with the bottom cover 13, the first communication opening 150 is completely misaligned with the liquid injection opening 130, the second communication opening 152 is completely misaligned with the pressure relief opening 132, and only the connecting through hole 151 and the sensing air passage 131 are aligned with and in communication with each other. In use, the user can slide the air regulating member 19 to change the air intake area of the air inlet 116 to adjust the air intake amount of the electronic cigarette 100.

Referring to FIG. 8, when liquid injection is required, the rotating liquid injection cover 15 is rotated in the direction indicated by the arrow until the first communication opening 150 is in communication with the liquid injection opening 130, and at this time, the second communication opening 152 is also in communication with the pressure relief opening 132. Then, the oil injection nozzle of the e-liquid bottle is inserted into the liquid injection opening 130 through the first communication opening 150 to inject the e-liquid into the liquid storage chamber 110. After the liquid injection is completed, the rotating liquid injection cover 15 is rotated in the opposite direction of the arrow to reset.

Please refer to FIG. 9, when the atomizing core 17 needs to be replaced or maintained, the same operation is performed as the liquid injection to rotate the rotating liquid injection cover 15 in the direction indicated by the arrow, the limiting buckle 156 of the rotating liquid injection cover 15 is disengaged from the mating buckle 136, and the rotating liquid injection cover 15 is pulled out, so that the atomizing core 17 can be drawn out from the main body 11, which is convenient for operation.

In the cartridge 10 and the electronic cigarette 100 of the present disclosure, the rotating liquid injection cover 15 arranged at the bottom of the cartridge 10 can rotate relative to the bottom cover 13 under the action of an external force, so that during the liquid injection process, the liquid injection can be realized only by misaligning the two to expose the liquid injection opening 130, the operation is simple and convenient. At the same time, the bottom cover 13 is further provided with the pressure relief opening 132, when the liquid injection opening 130 is exposed, the pressure relief opening 132 also communicates with the outside environment at the same time, so as to prevent the injected e-liquid from overflowing due to the air pressure in the liquid storage chamber 110.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A cartridge, comprising:

a main body with a liquid storage chamber therein, the main body comprising a semi-closed end and an open end opposite to the semi-closed end;

a bottom cover mounted at the open end of the main body, the bottom cover provided with a liquid injection opening and a pressure relief opening both of which are in communication with the liquid storage chamber, and a rotating liquid injection cover mounted to the bottom cover, the rotating liquid injection cover provided with a first communication opening and a second communication opening;

wherein the rotating liquid injection cover rotates about an axis relative to the bottom cover, the rotating liquid injection cover can be rotated to a first position in which the first communication opening is staggered from the liquid injection opening and the second communication opening is staggered from the pressure relief opening, and a second position in which the first communication opening is in communication with the liquid injection opening and the second communication opening is in communication with the pressure relief opening, the main body is provided with an air intake passage extending through the semi-closed end and the open end of the main body and an air inlet in communication with the air intake passage, the bottom cover is provided with a sensing air passage in communication with the air intake passage, the rotating liquid injection cover is provided with a connecting through hole in communication with the sensing air passage;

the cartridge comprises an atomizing core, the bottom cover is provided with an assembling hole; the liquid injection opening, the pressure relief opening and the sensing air passage are all arranged at the outer periphery of the assembling hole, an air inlet end of the atomizing core is detachably mounted to the rotating liquid injection cover, an air outlet end of the atomizing core is detachably inserted into the assembling hole and extends into the main body; the air inlet, the air intake passage, the gap between the housing and the semi-closed end of the main body, and the inside space of the atomizing core jointly form an atomizing airflow path.

2. The cartridge according to claim 1, wherein the rotating liquid injection cover rotates about the axis relative to the bottom cover within a preset arc length.

3. The cartridge according to claim 1, wherein the rotating liquid injection cover comprises a cover body and a limiting buckle, the bottom cover comprises a seat and a mating buckle, the limiting buckle is protruded from the outer edge of the cover body, the mating buckle is protruded from the outer edge of the seat and is located on the rotation path of the limiting buckle, the limiting buckle is reciprocally rotatable to be engaged with the mating buckle within a preset arc length.

4. The cartridge according to claim 1, wherein a surface of the bottom cover facing the rotating liquid injection cover is provided with a guiding groove, a surface of the rotating liquid injection cover facing the bottom cover is protruded to provide with a guiding post, the guiding post is slidably arranged in the guiding groove.

5. The cartridge according to claim 1, wherein the cartridge further comprises a housing and an air regulating member, the housing is sleeved outside the main body and is provided with a sliding groove in communication with the air inlet, the air regulating member is assembled in the sliding groove and can slide along the sliding groove between a closed position of covering the air inlet and an open position of opening the air inlet.

6. The cartridge according to claim 5, wherein an outer surface of the main body is provided with first adjusting teeth, the first adjusting teeth is formed at the periphery of the air inlet and is located on the sliding path of the air regulating member from the closed position of covering the air inlet to the open position of opening the air inlet, a surface of the air regulating member facing the first adjusting teeth is provided with second adjusting teeth engaging with the first adjusting teeth.

7. The cartridge according to claim 1, wherein the cartridge comprises a vent tube, the vent tube is detachably assembled at the air outlet end of the atomizing core, the housing is provided with an air outlet at a position corresponding to the vent tube.

8. An electronic cigarette, comprising:

a cartridge according to claim 1; and a battery device configured for providing electric driving for the cartridge.

9. A cartridge, comprising:

a main body with a liquid storage chamber therein, the main body comprising an upper end and a lower end, the main body provided with an air intake passage extending through the upper end and the lower end of the main body and an air inlet in communication with the air intake passage;

a bottom cover mounted at the lower end of the main body, the bottom cover provided with a sensing air passage in communication with the air intake passage and a liquid injection opening and a pressure relief opening both of which are in communication with the liquid storage chamber; and a rotating liquid injection cover mounted to the bottom cover, the rotating liquid injection cover provided with a connecting through hole in communication with the sensing air passage, a first communication opening and a second communication opening;

wherein the rotating liquid injection cover rotates about an axis relative to the bottom cover, the rotating liquid injection cover can be rotated between a first position and a second position;

in the first position, the first communication opening is staggered from the liquid injection opening, the second communication opening is staggered from the pressure relief opening, and the connecting through hole is aligned with and in communication with the sensing air passage;

in the second position, the first communication opening is in communication with the liquid injection opening, the second communication opening is in communication with the pressure relief opening, and the connecting through hole is staggered from the sensing air passage;

a surface of the bottom cover facing the rotating liquid injection cover is provided with a guiding groove, the guiding groove is arc-shaped, a surface of the rotating liquid injection cover facing the bottom cover is protruded to provide with a guiding post, the guiding post is slidably arranged in the guiding groove so that the rotating liquid injection cover rotates about the axis relative to the bottom cover within a preset arc length;

the cartridge further comprises an atomizing core, the bottom cover is provided with an assembling hole, the rotating liquid injection cover is provided with a receiving hole corresponding to the assembling hole; one end of the atomizing core is inserted into the receiving hole and is detachably mounted to the rotating liquid injection cover, the other end of the atomizing core is detachably inserted into the assembling hole and extends into the main body.

10. The cartridge according to claim 9, wherein the bottom cover comprises a seat and a mating buckle formed on the seat, the rotating liquid injection cover comprises a cover body and a limiting buckle formed on the cover body, when the rotating liquid injection cover is located in the first position, the limiting buckle is engaged with the mating buckle, when the rotating liquid injection cover is rotated from the first position to the second position, the limiting buckle is disengaged from the mating buckle.

11. The cartridge according to claim 10, wherein the limiting buckle is protruded from the outer edge of the cover body, the mating buckle is protruded from the outer edge of the seat and is located on the rotation path of the limiting buckle.

12. The cartridge according to claim 10, wherein the mating buckle defines a mating groove along the rotation path of the limiting buckle, the mating groove has a blocking wall on the path through which the limiting buckle rotates into the mating groove, the limiting buckle is rotated into the mating groove through the entrance of the mating groove and is blocked by the blocking wall facing the entrance of the mating groove.

13. The cartridge according to claim 12, wherein the limiting buckle is protruded to form a limiting protrusion facing the bottom cover, the mating buckle is provided with a limiting groove corresponding to the limiting protrusion and in communication with the mating groove, the limiting protrusion is engaged into the limiting groove when the limiting protrusion is rotated into the mating groove.

14. The cartridge according to claim 9, wherein the liquid injection opening, the pressure relief opening, the sensing air passage and the guiding groove are arranged at the outer periphery of the assembling hole; the first communication opening, the second communication opening and the connecting through hole are arranged at the outer periphery of the receiving hole.

15. The cartridge according to claim 9, wherein the cartridge further comprises a housing and an air regulating member, the housing is sleeved outside the main body and is provided with a sliding groove in communication with the air inlet, the air regulating member is assembled in the sliding groove and can slide along the sliding groove between a closed position of covering the air inlet and an open position of opening the air inlet.

16. The cartridge according to claim 15, wherein the air inlet is located at one end of the sliding groove, an outer surface of the main body is provided with first adjusting teeth, the first adjusting teeth is located on the sliding path of the air regulating member from the closed position of covering the air inlet to the open position of opening the air inlet, a surface of the air regulating member facing the first adjusting teeth is provided with second adjusting teeth engaging with the first adjusting teeth.

* * * * *